US008601912B2

(12) United States Patent
Huang et al.

(10) Patent No.: US 8,601,912 B2
(45) Date of Patent: Dec. 10, 2013

(54) HEX WRENCH

(75) Inventors: Chien-Feng Huang, Taipei Hsien (TW); Zih-Wei Wang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 566 days.

(21) Appl. No.: 12/981,551

(22) Filed: Dec. 30, 2010

(65) Prior Publication Data

US 2012/0085202 A1 Apr. 12, 2012

(30) Foreign Application Priority Data

Oct. 7, 2010 (TW) ..... 099134121

(51) Int. Cl.
*B25B 13/30* (2006.01)

(52) U.S. Cl.
USPC ..... 81/90.3; 81/90.7; 29/252; 29/261

(58) Field of Classification Search
USPC ..... 81/90.2, 90.3, 90.7, 90.9; 29/255, 252, 29/270, 278
See application file for complete search history.

(56) References Cited

U.S. PATENT DOCUMENTS 5,419,027 A * 5/1995 McPeak et al. ..... 29/252
6,266,861 B1 * 7/2001 Chen ..... 29/261

* cited by examiner

*Primary Examiner* — Monica Carter
*Assistant Examiner* — Melanie Alexander
(74) *Attorney, Agent, or Firm* — Altis Law Group, Inc.

(57) ABSTRACT

A hex wrench includes a main body, a handle connected with the main body, a rotary member, a lifting member, a driving member, and a matching member. The rotary member includes an operation portion and a shaft portion. The driving member includes six host driving members and six guest driving members. The matching member includes six matching blocks. The shaft portion passes through the main body. One end of the shaft portion is connected to the operation portion, the other opposite end is connected to the lifting member. One end of each host driving member is rotatably connected with the lifting member, the other end is rotatably connected with a middle portion of a corresponding guest driving member. One end of each guest driving member is rotatably connected with the main body, the other end is rotatably connected to a corresponding matching block.

18 Claims, 4 Drawing Sheets

HEX WRENCH

BACKGROUND

1. Technical Field

The present disclosure relates to wrenches and, particularly, to a hex wrench.

2. Description of Related Art

A typical hex wrench can only twist a hex socket bolt of a matched size. Therefore, to twist hex socket bolts of different sizes, different types of hex wrenches are needed, which is inconvenient.

Therefore, it is desirable to provide a hex wrench, which can overcome the described limitations.

DETAILED DESCRIPTION

Figure 1:
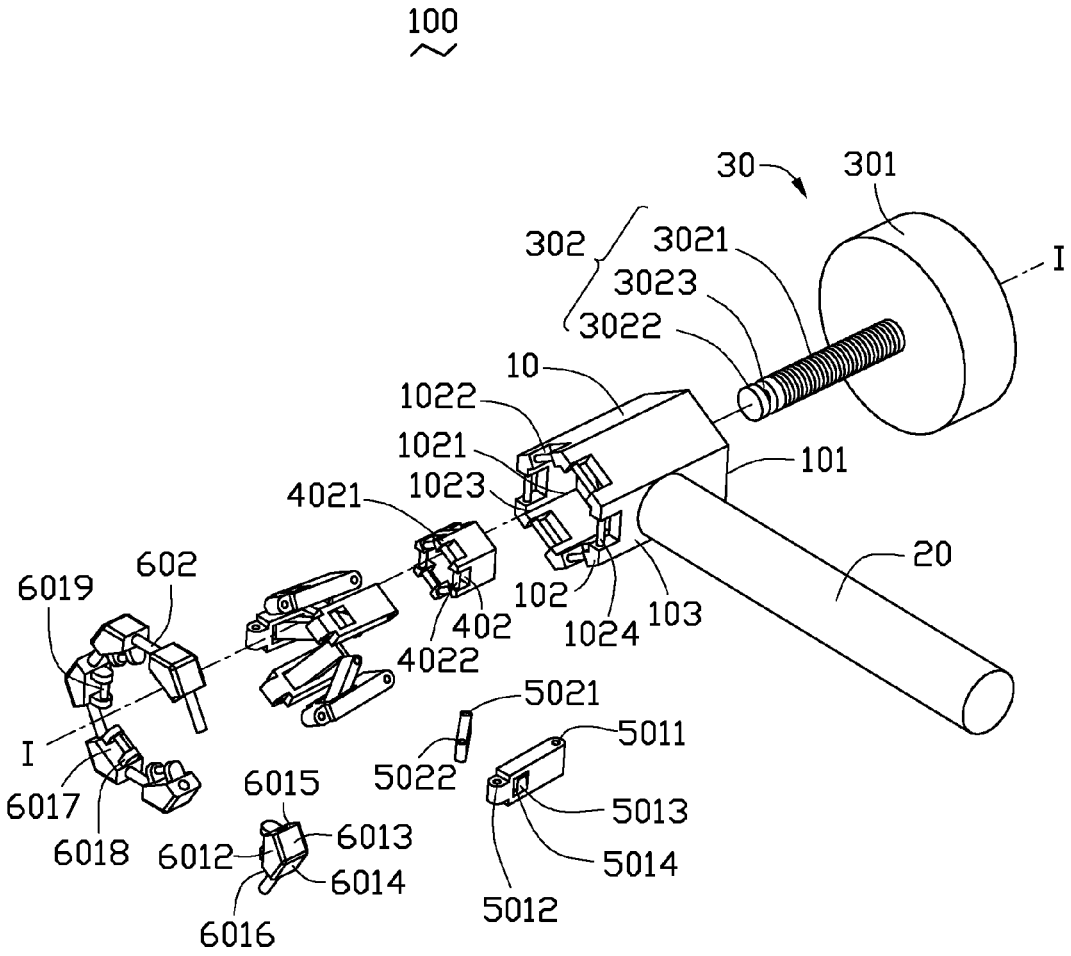
FIG. 1 is an exploded, isometric view of a hex wrench, according to an embodiment.
Figure 2:
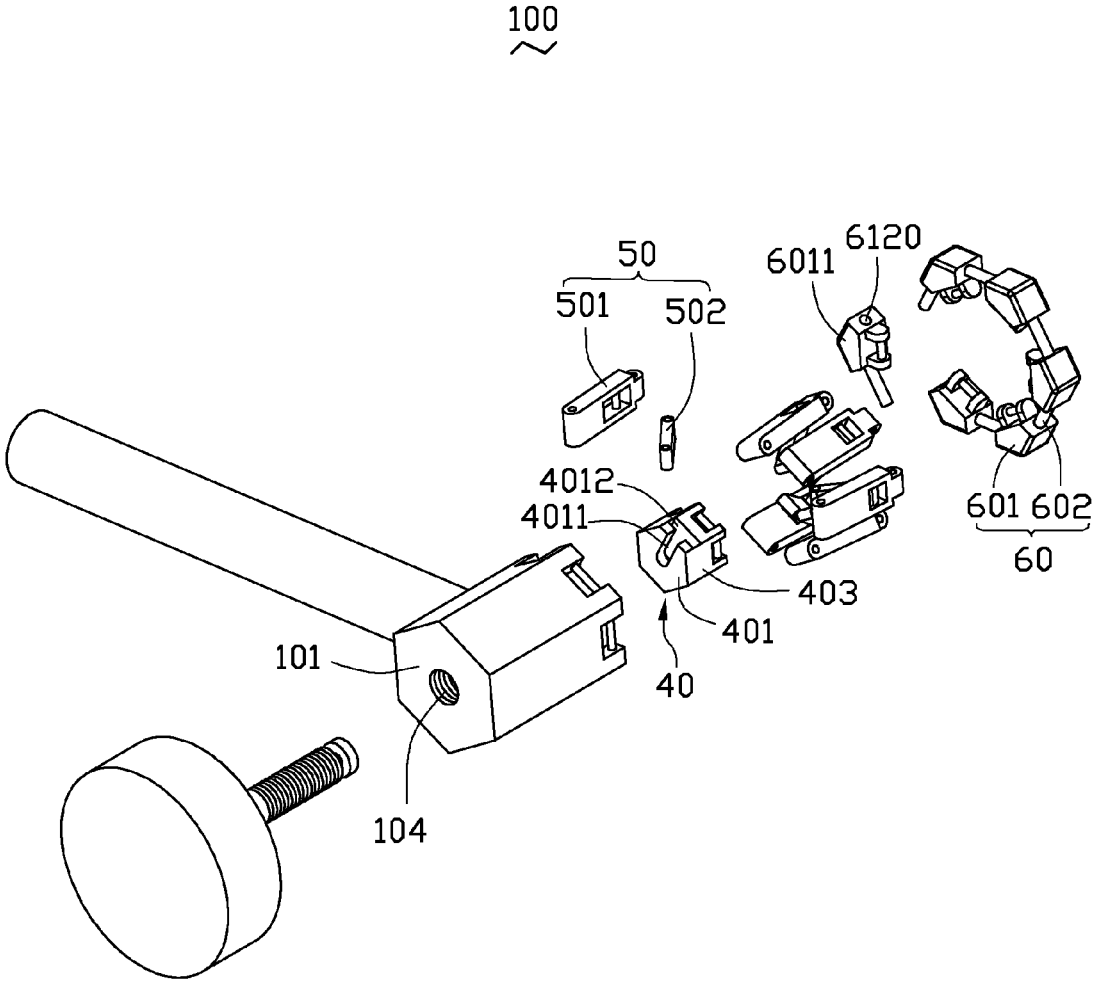
FIG. 2 is similar to FIG. 1, but viewed from another angle.

Referring to FIGS. 1-2, a hex wrench 100, according to an embodiment, includes a main body 10, a handle 20, a rotary member 30, a lifting member 40, a driving member 50, and a matching member 60.

The main body 10 is generally a hexagonal column and is symmetrical about a central axis I-I thereof. The main body 10 includes a first top surface 101, a first bottom surface 102 opposite to the first top surface 101, and six first side surfaces 103 connected between the first top surface 101 and the first bottom surface 102. The main body 10 defines a receiving space 1021 in the first bottom surface 102. The main body 10 further defines a screw hole 104. The screw hole 104 extends through the main body 10 along the central axis I-I. The receiving space 1021 is a hexagonal column in shape and forms six inner surfaces 1023 parallel to the respective first side surfaces 103. The main body 10 defines six notches 1022 in the first bottom surface 102. The notches 1022 extend through the main body 10 from the respective inner surfaces 1023 to the respective first side surfaces 103 and thus communicate the receiving space 1021 with outside. Six first hinges 1024 extend across the respective notches 1022, each first hinge 1024 is arranged along a direction parallel to the respective first side surface 103, the respective inner surface 1023, and the first top surface 101.

The handle 20 is generally a cylinder in shape and connected with a central portion of one of the first side surfaces 103.

The rotary member 30 comprises an operation portion 301 and a shaft portion 302. The operation portion 301 is generally a cylinder in shape. The shaft portion 302 is a shaft coaxially extending out from the center of the operation portion 301. The shaft portion 302 defines an exterior threaded section 3021, corresponding to the screw hole 104, adjacent to the operation portion 301. The shaft portion 302 also includes a neck portion 3023 at a distal end of the operation portion 301, thereby leaving an engaging portion 3022 at a side of the neck portion 3023 opposite to the operation portion 301. The diameter of the engaging portion 3022 is greater than the neck portion 3023 along a radical direction of the shaft portion 302.

The lifting member 40 is generally a hexagon column. The lifting member 40 includes a second top surface 401, a second bottom surface 402 opposite to the second top surface 401, and six second side surfaces 403 connected between the second top surface 401 and the second bottom surface 402. The lifting member 40 defines a first groove 4011 in the second top surface 401. The first groove 4011 extends from the center of the second top surface 401 along the radial direction of the lifting member 40 to one of the second side surfaces 403 and thus communicates with outside by the second side surface 403. The lifting member 40 also defines a second groove 4012 in one of the second side surfaces 403, which communicates with the first groove 4011. The second groove 4012 communicates with first groove 4011. The depth of the first groove 4011 along the axial direction of the lifting member 40 is equal to or slightly greater than the thickness of the neck portion 3023 along the axial direction of lifting member 40, and the width of the first groove 4011 along a direction perpendicular to the axial direction of the lifting member 40 is greater than a diameter of the neck portion 3023 and less than a diameter of the engaging portion 3022. The depth of the second groove 4012 along the axial direction of the lifting member 40 is equal to or slightly greater than the thickness of the engaging portion 3022 along the axial direction of the lifting member 40, and the width of the second groove 4012 along a direction perpendicular to the axial direction of the lifting member 40 is greater than the diameter of the engaging portion 3022. Six protrusions 4021 perpendicularly extend from the six corners of the second bottom surface 402. Six second hinges 4022 extend along a direction parallel to the respective second side surfaces 403 and the second top surface 401.

The driving member 50 includes six guest driving members 501 and six host driving members 502. Each guest driving member 501 is generally a cuboid and defines a first pivoting hole 5011 at one end thereof, a second pivoting hole 5012 at the other opposite end thereof, and a through hole 5013 in the middle portion between the first pivoting hole 5011 and the second pivoting hole 5012. The first pivoting hole 5011 and the second pivoting hole 5012 are parallel to each other and extend through a first pair of opposite surfaces of the guest driving member 501. The through hole 5013 extends through a second pair of opposite surfaces perpendicular to the first pair of opposite surfaces through which the first and second pivoting holes 5011, 5012 extend. A third hinge 5014 substantially parallel to the first pivoting hole 5011 is mounted in the through hole 5013. Each host driving member 502 is generally a cuboid in shape and defines a first connection hole 5021 at one end thereof and a second connection hole 5022 at the opposite end thereof. The first connection hole 5021 and the second connection hole 5022 are parallel to each other and extend through a pair of opposite surfaces of the host driving member 502.

The matching member 60 includes six matching blocks 601 and six aligning shafts 602. Each matching block 601 is generally a pentagon column in shape and includes a third top surface 6011, a third bottom surface 6012 opposite to the third top surface 6011, a first matching surface 6013, a second matching surface 6014, a first connection surface 6015, a second connection surface 6016, and an engagement surface 6017. The first and second matching surfaces 6013, 6014 connect to each other and form an angle of about 120 degrees therebetween. The first connection surface 6015 and the second connection surface 6016 respectively connects with the first matching surface 6013 and the second matching surface 6014. The first connection surface 6015 and the second connection surface 6016 both define blind holes 6120 for partially receiving the aligning shaft 602. The engagement surface 6017 connects between the first connection surface 6015 and the second connection surface 6016. A pair of shaft seats 6018 extends from each engagement surface 6017. A connection shaft 6019 is mounted between the pair of shaft seats 6018 and extends along a direction parallel to the respective engagement surface 6017 and the third top surface 6011.

Figure 3:
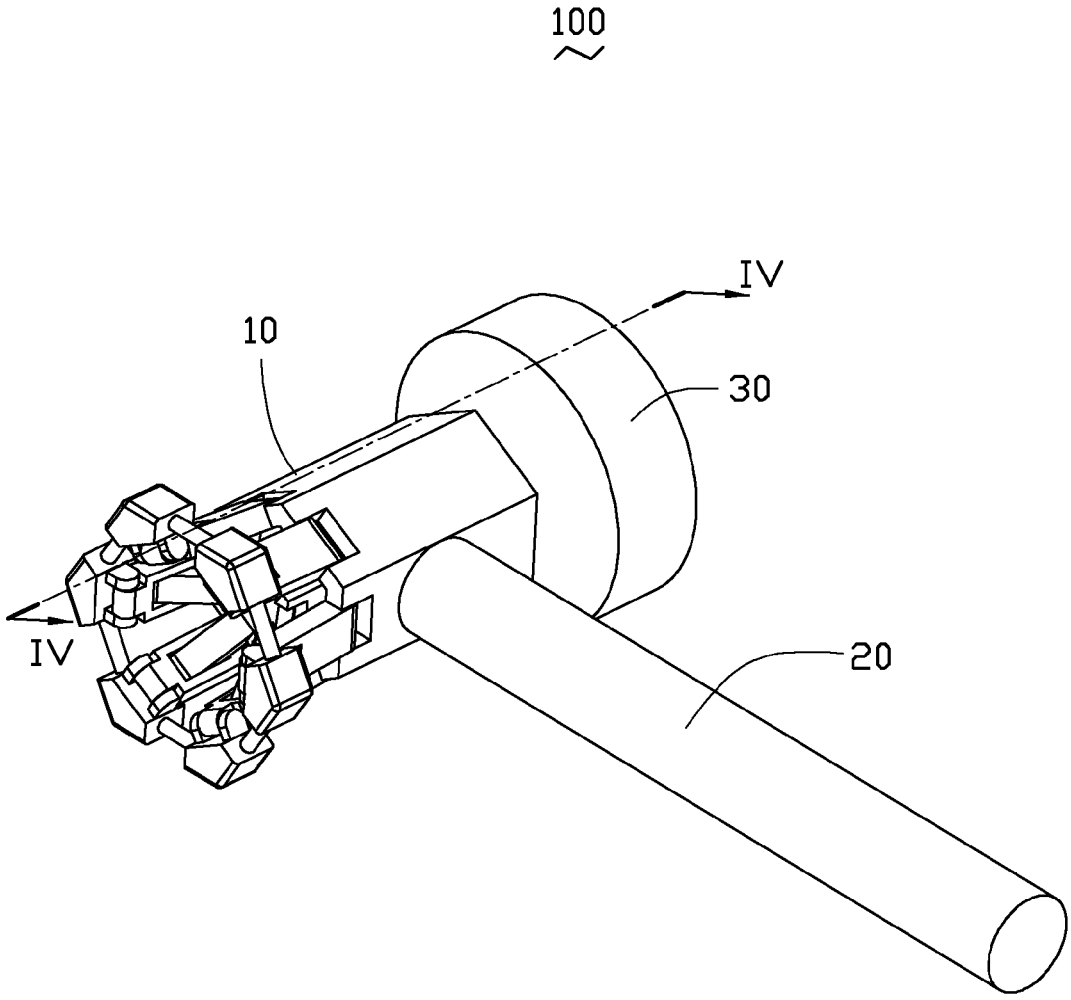
FIG. 3 is an assembled view of the hex wrench of FIG. 1.
Figure 4:
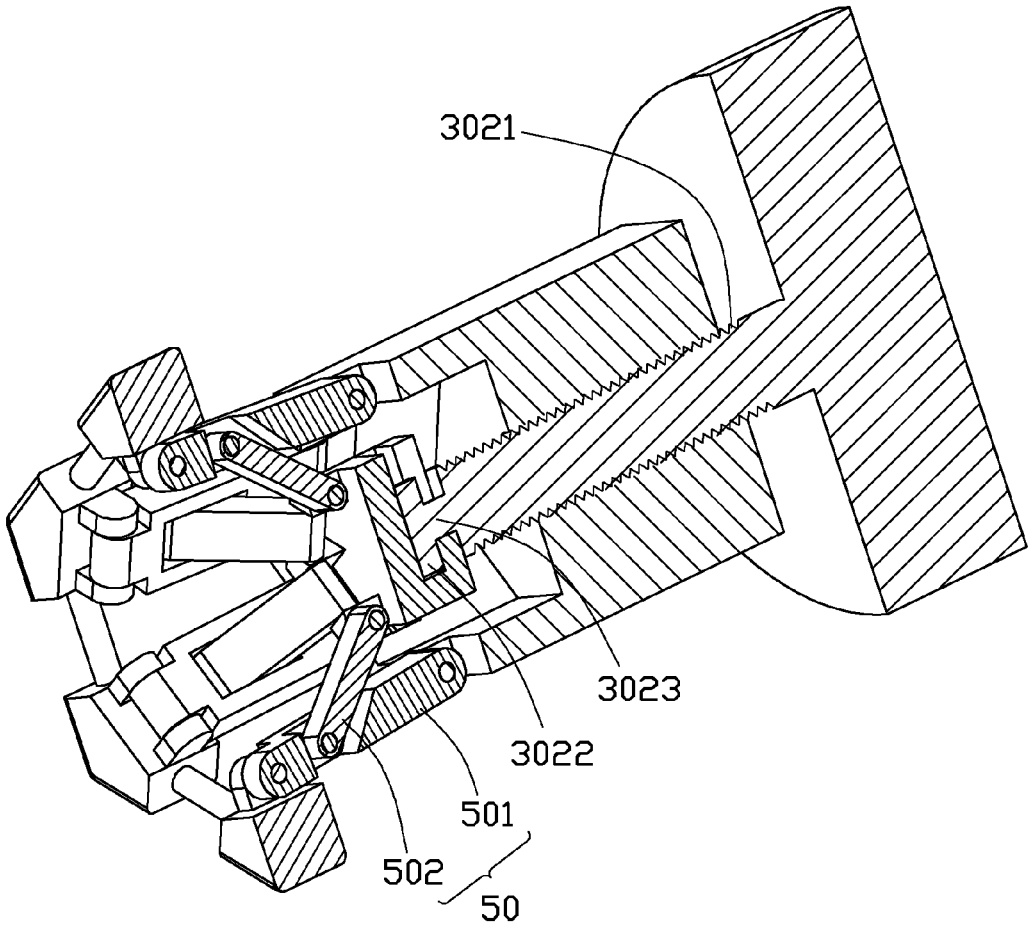
FIG. 4 is a cross-sectional view of the hex wrench, taken along a line IV-IV of FIG. 3.

Referring to FIGS. 1, 3, and 4, when assembling the hex wrench 100, firstly, one end of the handle 20 is connected to one of the first side surfaces 103. The shaft portion 302 is engaged with the screw hole 104, with the screw hole 104 engaging with the exterior threaded section 3021. The lifting member 40 is received in the receiving space 1021 with the neck portion 3023 and the engaging portion 3022 respectively clamped in the first groove 4011 and the second groove 4012. The lifting member 40 is coaxial with the main body 10. Then each first hinge 1024 is received in a corresponding first pivoting hole 5011 and is mounted to a corresponding notch 1022. Each second hinge 4022 is received in the corresponding first connection hole 5021 and is mounted to two adjacent protrusions 4021. Each third hinge 5014 is received in the corresponding second connection hole 5022 and mounted to the corresponding through hole 5013. The six guest driving members 501 and the six host driving members 502 are symmetrical about the central axis I-I. The two ends of each aligning shaft 602 are partially received in the blind holes 6120 of two neighbored matching blocks 601. Then, each connection shaft 6019 is received in the corresponding second pivoting hole 5012 and is mounted to the pair of shaft seats 6018. The six matching blocks 601 and six aligning shafts 602 are symmetrical about the central axis I-I. The first matching surface 6013 and the second matching surface 6014 attach to a bolt hole of a hex socket bolt (not shown). The six matching blocks 601 jointly form a hexagonal column for matching the bolt hole.

In use, when the size of the bolt hole is smaller than the hexagonal column in which the six matching blocks 601 are jointly formed. A counterclockwise rotation of the rotary member 30, pulls the lifting member 40 to move towards the main body 10, the host driving member 502 pulls the guest driving member 501 to move towards the central axis I-I. Each guest driving member 501 brings the corresponding matching block 601 to move towards the central axis I-I until the size of the hexagonal column formed by the six matching blocks 601 is equal to the bolt hole. When the size of the bolt hole is greater than the hexagonal column formed by the six matching blocks 601, a clockwise rotation of the rotary member 30 will adjust the size of the hexagonal column until the six matching blocks 601 are jointly formed to engage with the bolt hole. During the rotation of the rotary member 30, the matching blocks 601 are slidable about the aligning shafts 602 to keep the matching blocks 601 aligned on a plane.

The hex wrench 100 is adjustable for hex socket bolts of different sizes. Therefore, it is convenient to use.

It will be understood that the above particular embodiments are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. A hex wrench, comprising:

a main body;

a handle connected with the main body;

a rotary member comprising an operation portion and a shaft portion;

a lifting member;

a driving member comprising six host driving members and six guest driving members, each guest driving member comprising a middle portion, one end of each host driving member being rotatably connected with the lifting member, and the other opposite end of each host driving member being rotatably connected with the middle portion of a corresponding guest driving member; and a matching member comprising six matching blocks for matching with a hex socket bolt;

wherein the shaft portion passes through the main body, one end of the shaft portion is connected to the operation portion, the other opposite end of the shat portion is engaged with the lifting member; one end of each guest driving member is rotatably connected with the main body, and the other opposite end of each guest driving member is rotatably connected with a corresponding one of the matching blocks.

2. The hex wrench of claim 1, wherein the main body is a hexagonal column in shape and comprises a first top surface, a first bottom surface opposite to the first top surface, and six side surfaces connected between the first top surface and the first bottom surface.

3. The hex wrench of claim 2, wherein the main body defines a receiving space in the first bottom surface, the receiving space is a hexagonal column in shape and forms six inner surfaces parallel to the respective first side surfaces; the lifting member is received in the receiving space.

4. The hex wrench of claim 3, wherein the shaft portion has an exterior threaded section, the main body defines a screw hole, the screw hole extends through the main body along a central axis of the main body and communicates with the receiving space, the exterior threaded section engages with the screw hole.

5. The hex wrench of claim 3, wherein the main body defines six notches in the first bottom surface, the notches extend from the respective inner surfaces to the respective first side surfaces and communicate with the receiving space, the main body comprises six first hinges extending across the respective notches, each first hinge is arranged along a direction parallel to a corresponding first side surface and inner surface and the first top surface, each guest driving member is rotatably connected with a corresponding first hinge.

6. The hex wrench of claim 5, wherein each guest driving member defines a first pivoting hole at one end, the first pivoting hole receives the corresponding first hinge.

7. The hex wrench of claim 6, wherein each guest driving member defines a second pivoting hole opposite to the first pivoting hole thereof; each matching block comprises an engagement surface, a pair of shaft seats extending from the engagement surface, and a connection shaft mounted between the pair of shaft seats, the connection shaft is received in a corresponding second pivoting hole.

8. The hex wrench of claim 2, wherein the handle is a cylinder and connected to one of the first side surfaces.

9. The hex wrench of claim 1, wherein the shaft portion comprises a neck portion at a distal end thereof, and thereby leaving an engaging portion at a side of the neck portion opposite to the operation portion, a diameter of the neck portion is smaller than that of the engaging portion; the lifting member comprises a second top surface, a second bottom surface, and six second side surfaces connected between the second top surface and the second bottom surface, the lifting member defines a first groove in the second top surface and a second groove in a corresponding second side surface, the first groove extends along a radial direction of the lifting member from a center of the first top surface to the corresponding second side surface, the first groove communicates with the second groove; the neck portion is received in the first groove, the engaging portion is received and confined in the second groove.

10. The hex wrench of claim 9, wherein the depth of the first groove along an axial direction of the lifting member is equal to or slightly greater than the thickness of the neck portion along the axial direction of lifting member, and the width of the first groove along a direction perpendicular to the axial direction of the lifting member is greater than the diameter of the neck portion and less than the diameter of the engaging portion.

11. The hex wrench of claim 9, wherein the depth of the second groove along the axial direction of the lifting member is equal to or slightly greater than the thickness of the engaging portion along the axial direction of the lifting member, and the width of the second groove along a direction perpendicular to the axial direction of the lifting member is greater than the diameter of the engaging portion.

12. The hex wrench of claim 9, wherein the lifting member comprises six protrusions and six second hinges, the protrusions extend from the second bottom surface, each second hinge is mounted on two adjacent protrusions; each host driving member is rotatably connected with a corresponding second hinge.

13. The hex wrench of claim 12, wherein each host driving member defines a first connection hole at one end, the first connection hole receives the corresponding second hinge.

14. The hex wrench of claim 13, wherein each host driving member defines a second connection hole opposite to the first connection hole; each guest driving member defines a through hole in the middle portion thereof, a third hinge is mounted in the through hole, the third hinge is received in a corresponding second connection hole.

15. The hex wrench of claim 1, wherein each matching block is a pentagon column in shape and comprises a third top surface, a third bottom surface opposite to the third top surface, a first matching surface, a second matching surface, a first connection surface, a second connection surface, and an engagement surface.

16. The hex wrench of claim 15, wherein the first matching surface and the second matching surface are connected to each other and arranged at an angle of about 120 degrees.

17. The hex wrench of claim 15, wherein the engagement surface connects between the first connection surface and the second connection surface, a pair of shaft seats extend from the engagement surface, a connection shaft is mounted between the pair of shaft seats; the connection shaft is rotatably connected with a corresponding guest driving member.

18. The hex wrench of claim 15, wherein the first connection surface and the second connection surface respectively connects with the first matching surface and the second matching surface, each of the first connection surface and the second connection surface defines a blind hole; the matching member comprises six aligning shafts, the two ends of each aligning shafts are received in the blind holes of two neighbored matching blocks.

* * * * *